US006422453B1

(12) United States Patent
Wang

(10) Patent No.: US 6,422,453 B1
(45) Date of Patent: Jul. 23, 2002

(54) FOLDABLE PAPER CONTAINER HAVING A TOP OPENING

(75) Inventor: Kuei-Lin Wang, Taipei (TW)

(73) Assignee: Big Tom International Ltd., Centre Hong Kong (CN)

( * ) Notice: Subject to any disclaimer, the term of this patent is extended or adjusted under 35 U.S.C. 154(b) by 0 days.

(21) Appl. No.: 10/067,247

(22) Filed: Feb. 7, 2002

(51) Int. Cl.[7] ..... B65D 5/42

(52) U.S. Cl. ..... 229/114; 206/562; 206/563; 229/902

(58) Field of Search ..... 229/114, 185, 229/902, 904; 206/562, 563, 564, 565

(56) References Cited

U.S. PATENT DOCUMENTS 2,308,128 A * 1/1943 Tanner ..... 229/185
2,466,636 A * 4/1949 Bruckner et al. ..... 229/904
2,808,191 A * 10/1957 Cramer ..... 229/904
3,366,303 A * 1/1968 Kaspar ..... 206/563
3,529,763 A * 9/1970 Wagner ..... 229/114
3,899,119 A * 8/1975 Roccaforte ..... 206/563
4,572,423 A * 2/1986 Spencer ..... 206/562
4,895,529 A * 1/1990 Paley ..... 229/904
5,464,150 A * 11/1995 Sanchez et al. ..... 206/562
6,311,842 B1 * 11/2001 Minerich et al. ..... 206/563

FOREIGN PATENT DOCUMENTS

GB 2065072 A * 6/1981 ..... 229/114

* cited by examiner

*Primary Examiner*—Gary E. Elkins
(74) *Attorney, Agent, or Firm*—Bacon & Thomas, PLLC

(57) ABSTRACT

A foldable open container formed of a sheet of irregularly shaped hard paper. The container comprises a main board comprising four sectors each having a substantially trapezoidal side board and substantially trapezoidal four bottom boards; and an integral inner board comprising a main portion, four side flaps, and a central hole on main portion. In use, user may insert his/her thumb into a heart-shaped opening on a side flap while holding the container by hand. Hence, for example, a waffle dish containing ice cream may be supported on the central hole. Further, a spoon may hang on an arcuate slot on the main portion.

6 Claims, 5 Drawing Sheets

FOLDABLE PAPER CONTAINER HAVING A TOP OPENING

FIELD OF THE INVENTION

The present invention relates to an open container formed of paper and more particularly to a foldable paper container having a top opening.

BACKGROUND OF THE INVENTION

Open containers are known. Also, open containers being foldable are known. However, above are unsatisfactory for the purpose for which the invention is concerned. Hence, a need exists for an improved foldable paper container having a top opening which designed to allow a waffle dish to be placed on it.

SUMMARY OF THE INVENTION

It is therefore an object of the present invention to provide an open container formed by folding a sheet of irregularly shaped hard paper. In use, user can hold the container by hand for supporting, for example a waffle dish containing ice cream and a spoon therein.

To achieve the above and other objects, the present invention provides a foldable open container formed of a sheet of irregularly shaped hard paper. The open container comprises a main board comprising first, second, third, and fourth sectors having substantially trapezoidal first, second, third, and fourth side boards respectively wherein each pair of the first and the second side boards, the second and the third side boards, and the third and the fourth side boards are bordered with a solid folding line and substantially trapezoidal first, second, third, and fourth bottom boards respectively wherein the first sector further comprises a first flap at a side of the first side board and a slit between the first flap and the first side board, the fourth sector further comprises a second flap at a side of the fourth side board bordered with the fourth side board with a dotted folding line, the second flap having a length longer than that of the slit for being permitted to insert into the slit, the second bottom board comprises a tongue, and the fourth bottom board comprises a recess and two shoulders on opposite sides of the recess; and an inner board comprising a main portion, first, second, third, and fourth side flaps each extended from the main portion wherein two opposite end portions of an outer edge of the fourth side board are coupled to the first side flap, and a central circular hole on the main portion; wherein in assembly, the tongue is inserted through the mated recess to position under the fourth bottom board while the shoulders are positioned under the second bottom board, the first bottom board is partially lain over the third bottom board, and the first, the second, the third, and the fourth side flaps are folded to engage with the fourth, the first, the second, and the third side boards, thus leaving the main portion above the main board.

In a first aspect of the present invention, further comprises two opposite groups of continuous sectors on the central circular hole wherein each group is permitted to fold downward along a dotted folding line bordered with the main portion and two adjacent sectors in each group are bordered with a solid folding line.

In a second aspect of the present invention, further comprises an arcuate slot on the main portion.

In a third aspect of the present invention, the second sector further comprises a flap member bordered the second side board with a dotted folding line, and the third side flap comprises an opening for permitting the flap member to bend there into.

In a fourth aspect of the present invention, each of the flap member and the opening is substantially heart-shaped or arcuate.

In a fifth aspect of the present invention, an outer edge of each side board is arcuate.

The above and other objects, features and advantages of the present invention will become apparent from the following detailed description taken with the accompanying drawings.

DETAILED DESCRIPTION OF THE PREFERRED EMBODIMENTS

Figure 1:
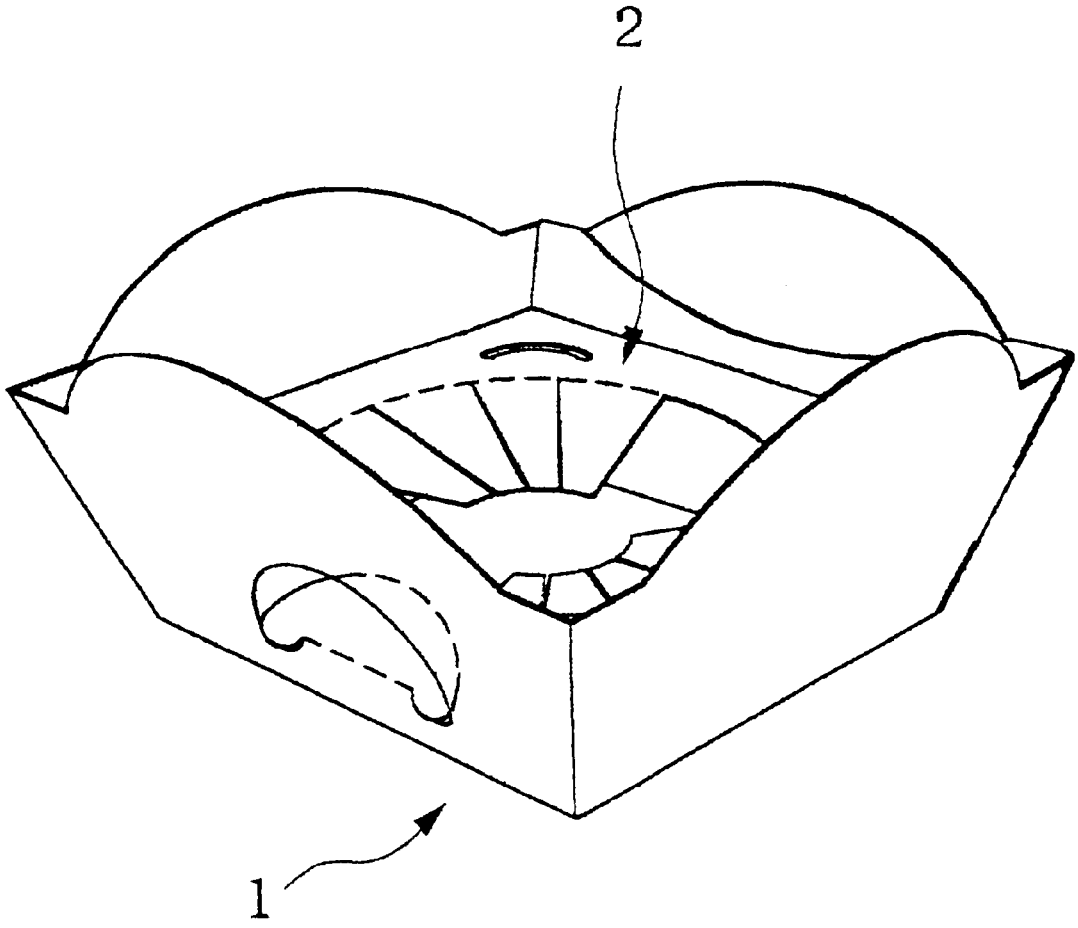
FIG. 1 is a perspective view of a paper container having a top opening according to the invention.
Figure 2:
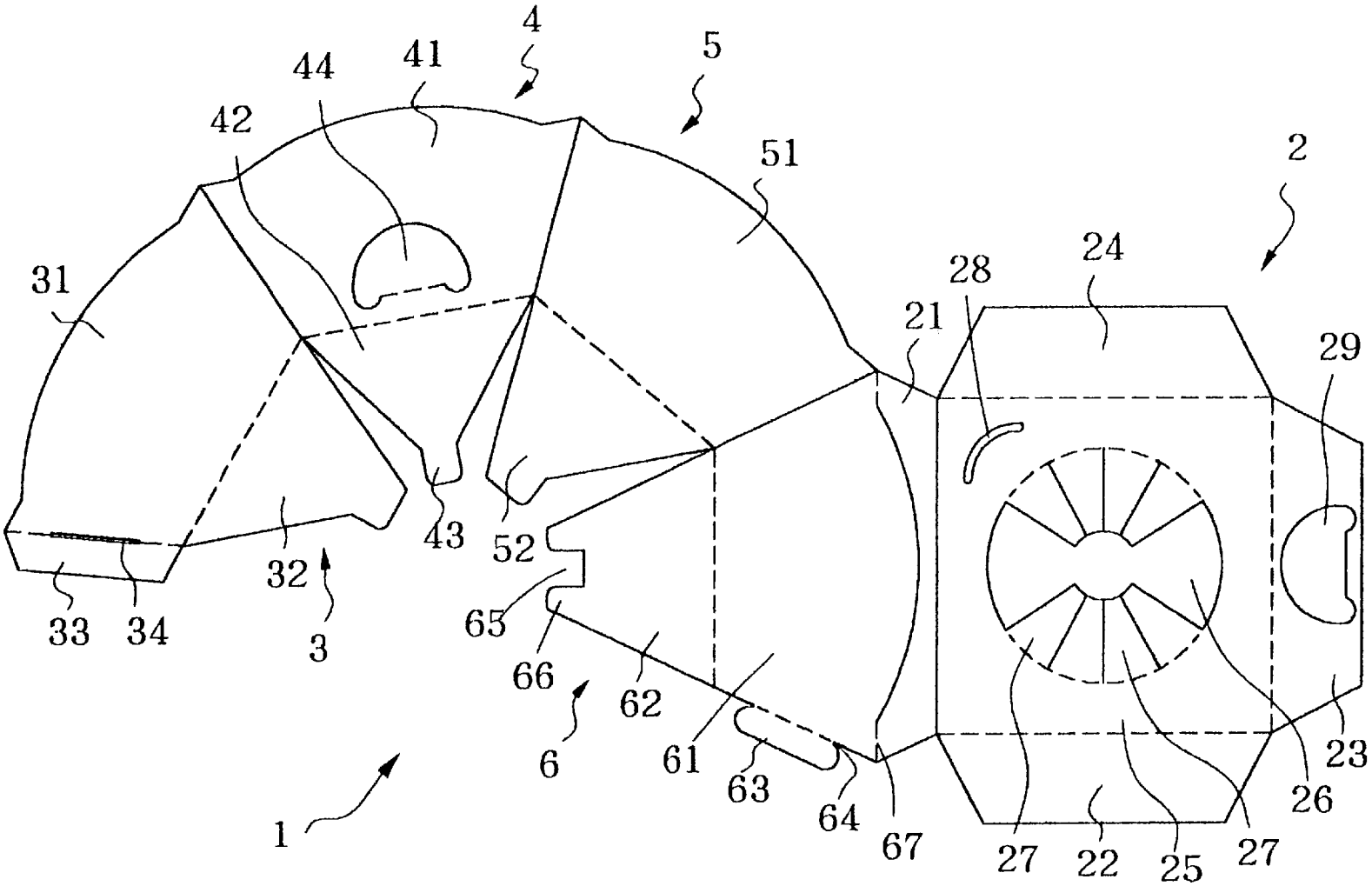
FIG. 2 is a top plan view of the extended container.
Figure 3:
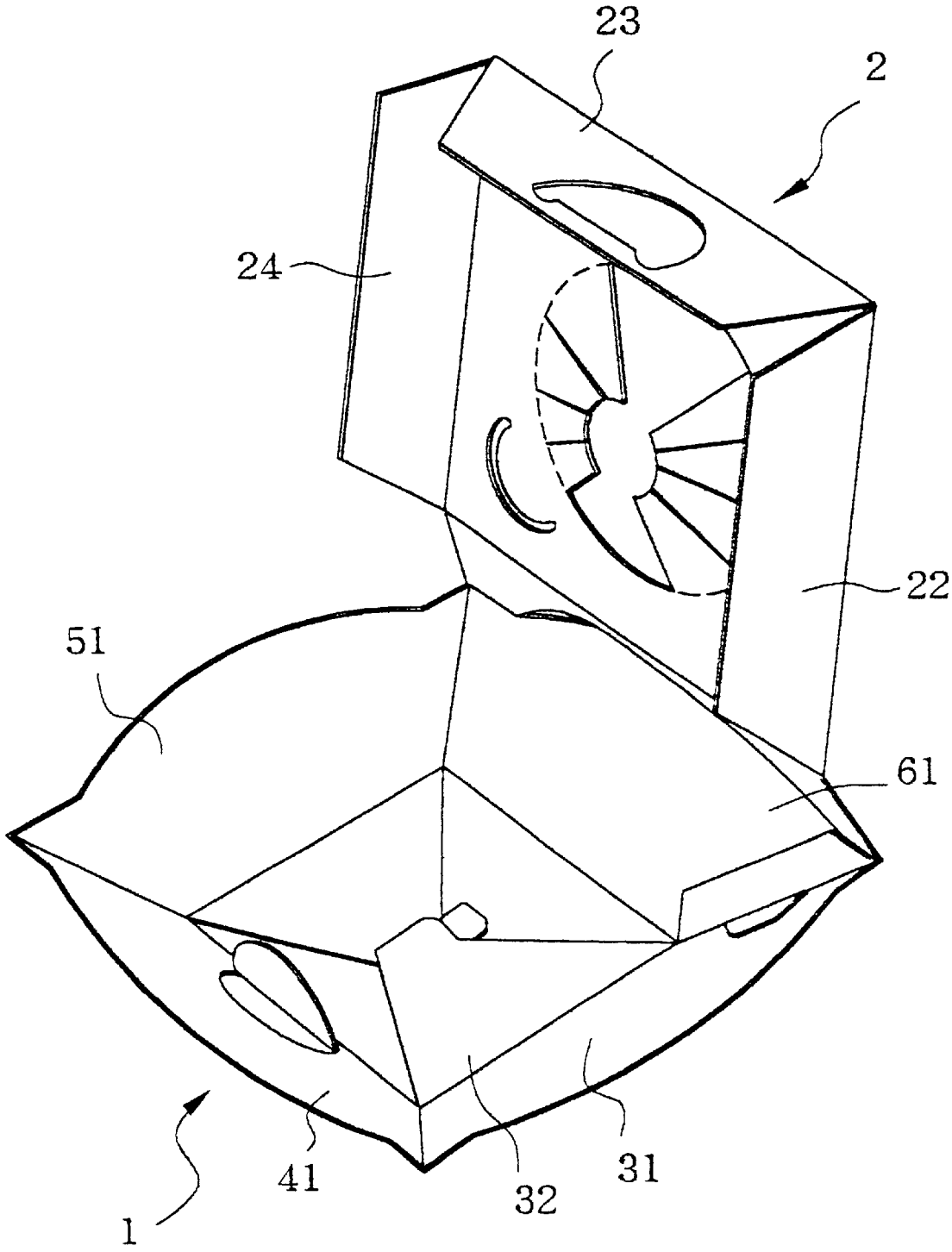
FIG. 3 is a perspective view of the partially folded container.
Figure 4:
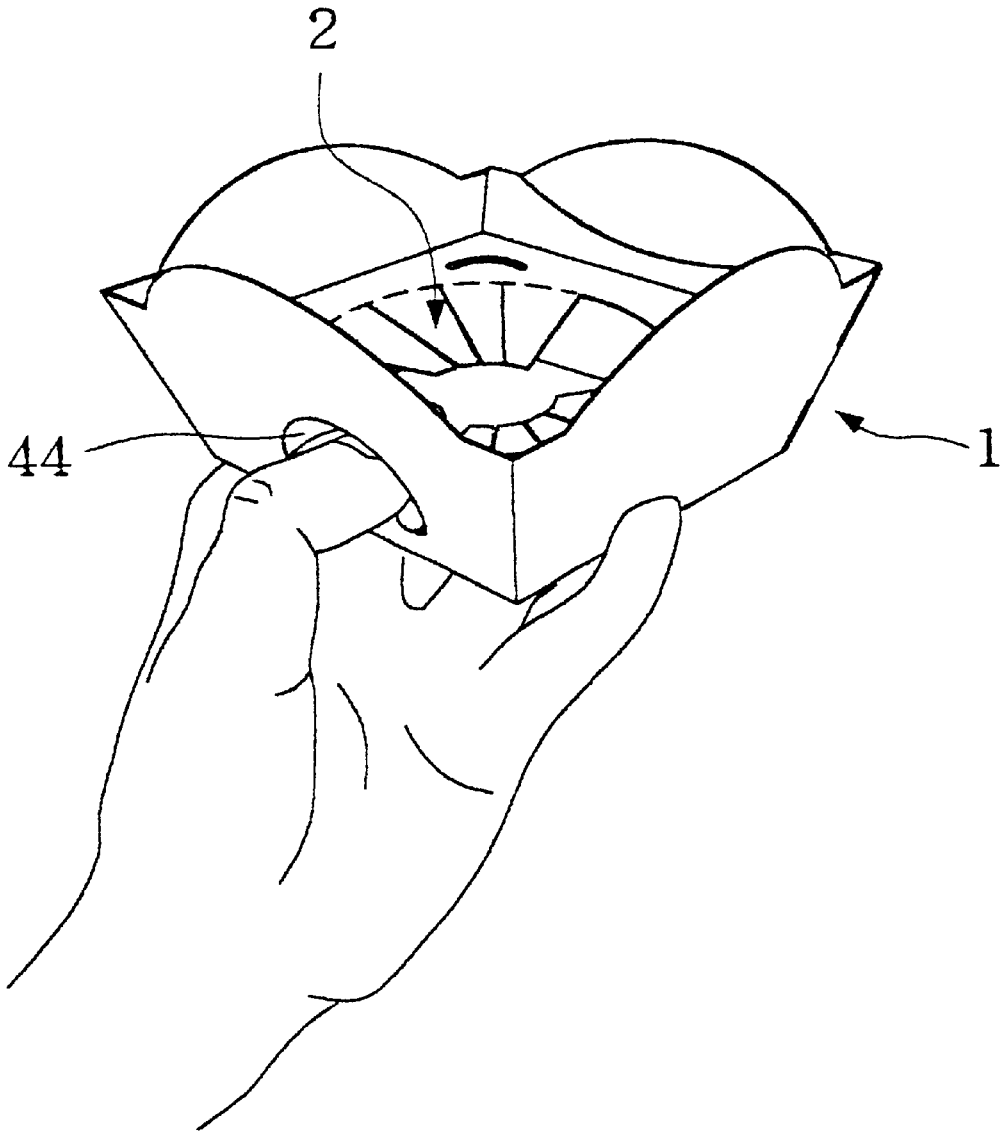
FIG. 4 is an environmental view showing the folded container held by hand.

Referring to FIGS. 1 to 4, there are shown an open container constructed in accordance with the invention. The open container is formed by folding a sheet of irregularly shaped hard paper. The sheet of hard paper comprises a main board 1 and an inner board 2 connected together. Main board 1 comprises first, second, third, and fourth sectors 3, 4, 5, and 6. Each of sectors has a substantially trapezoidal side board (e.g., first, second, third, or fourth side board 31, 41, 51, or 61) and a substantially trapezoidal bottom board (e.g., first, second, third, or fourth bottom board 32, 42, 52, or 62). Further, each of side boards 31, 41, 51, or 61 has an arcuate outer edge being visually attractive. Side boards 31 and 41 are bordered with a solid folding line. Similarly, side boards 41 and 51 and side boards 51 and 61 are bordered with a solid folding line respectively. First sector 3 further comprises a flap 33 at a side of first side board 31 and a slit 34 between flap 33 and first side board 31. Similarly, fourth sector 6 further comprises a flap 63 at a side of fourth side board 61 and a dotted folding line 64 between flap 63 and fourth side board 61. A length of flap 63 is longer than that of slit 34. But flap 63 is still allowed to insert into slit 34 for fastening. The second bottom board 42 comprises a tongue 43. Fourth bottom board 62 comprises a recess 65 and two shoulders 66 on opposite sides of recess 65. In assembly, tongue 43 is inserted through the mated recess 65 to position under fourth bottom board 62 while shoulders 66 are positioned under second bottom board 42. This forms a fastening. Further, first bottom board 32 is partially lain over third bottom board 52. This is best illustrated in FIG. 3. Moreover, second sector 4 further comprises a heart-shaped or arcuate flap 44 bordered second side board 41 with a dotted folding line.

Two opposite end portions of outer edge 67 of fourth side board 61 are coupled to a side flap 21 of inner board 2. Inner board 2 comprises a main portion 25, four side flaps 21, 22, 23, and 24 each coupled to the main portion 25, a central circular hole 26 on the main portion 25, two opposite groups of continuous sectors 27 wherein each group of sectors 27 and the main portion 25 are bordered with a dotted folding line and two adjacent sectors 27 in each group are bordered with a solid folding line, an arcuate slot 28, and a heart-shaped or arcuate opening 29 at side flap 23. In assembly, flaps 21, 22, 23, and 24 are folded to engage with side boards 61, 31, 41, and 51 respectively, thus leaving the main portion 25 above bottom of main board 1 by a distance about half the height of the open container. Finally, bend arcuate flap 44 into opening 29 for fastening. In use, a finger (e.g., thumb) may insert through flap 44 and opening 29 for holding the open container (see FIG. 4).

Figure 5:
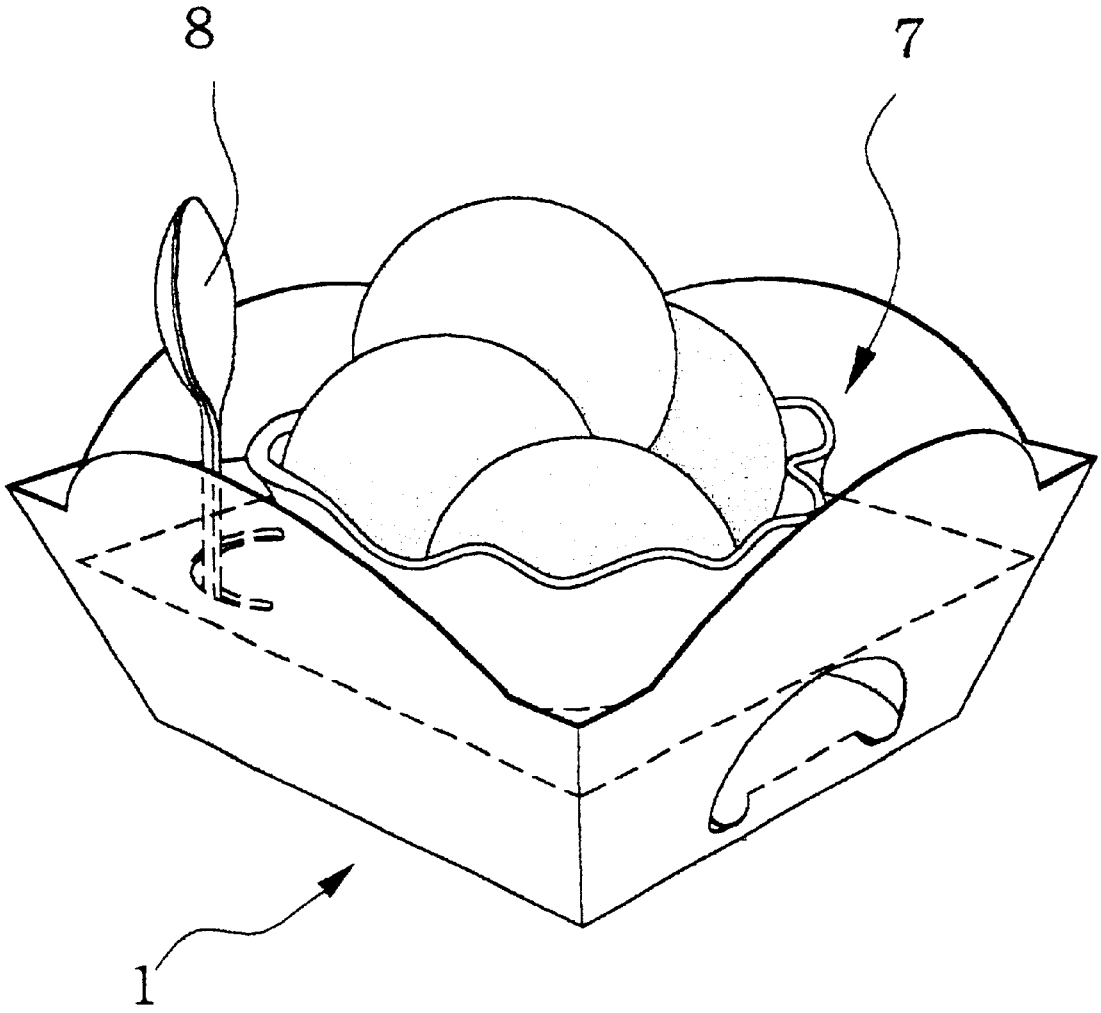
FIG. 5 is a perspective view showing a waffle dish containing ice cream and a spoon supported in the folded container.

Referring to FIG. 5, in use such as holding a waffle dish containing ice cream 7, user may place the waffle dish containing ice cream 7 on the hole 26 to cause groups of sectors 27 to fold downward along dotted folding lines due to the weight of ice cream contained in the waffle dish. Further, a spoon 8 may hang on the slot 28.

While the invention has been described by means of specific embodiments, numerous modifications and variations could be made thereto by those skilled in the art without departing from the scope and spirit of the invention set forth in the claims.

What is claimed is:

1. A foldable open container formed of a sheet of irregularly shaped hard paper, the open container comprising:

a main board comprising first, second, third, and fourth sectors having substantially trapezoidal first, second, third, and fourth side boards respectively wherein each pair of the first and the second side boards, the second and the third side boards, and the third and the fourth side boards are bordered with a solid folding line and substantially trapezoidal first, second, third, and fourth bottom boards respectively wherein the first sector further comprises a first flap at a side of the first side board and a slit between the first flap and the first side board, the fourth sector further comprises a second flap at a side of the fourth side board bordered with the fourth side board with a dotted folding line, the second flap having a length longer than that of the slit for being permitted to insert into the slit, the second bottom board comprises a tongue, and the fourth bottom board comprises a recess and two shoulders on opposite sides of the recess; and an inner board comprising a main portion, first, second, third, and fourth side flaps each extended from the main portion wherein two opposite end portions of an outer edge of the fourth side board are coupled to the first side flap, and a central circular hole on the main portion;

wherein in assembly, the tongue is inserted through the mated recess to position under the fourth bottom board while the shoulders are positioned under the second bottom board, the first bottom board is partially lain over the third bottom board, and the first, the second, the third, and the fourth side flaps are folded to engage with the fourth, the first, the second, and the third side boards, thus leaving the main portion above the main board.

2. The open container of claim 1, further comprising two opposite groups of continuous sectors on the central circular hole wherein each group is permitted to fold downward along a dotted folding line bordered with the main portion and two adjacent sectors in each group are bordered with a solid folding line.

3. The open container of claim 1, further comprising an arcuate slot on the main portion.

4. The open container of claim 1, wherein the second sector further comprises an arcuate flap member bordered the second side board with a dotted folding line, and the third side flap comprises an opening for permitting the flap member to bend thereinto.

5. The open container of claim 4, wherein each of the opening and the flap member is substantially arcuate or heart-shaped.

6. The open container of claim 1, wherein an outer edge of each side board is arcuate.

* * * * *